US007755886B2

(12) United States Patent
Peng et al.

(10) Patent No.: US 7,755,886 B2
(45) Date of Patent: Jul. 13, 2010

(54) MOUNTING APPARATUS FOR DATA STORAGE DEVICES

(75) Inventors: Wen-Tang Peng, Tu-Cheng (TW); Guang-Yi Zhang, Shenzhen (CN); Shao-Kun Chen, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 1061 days.

(21) Appl. No.: 11/308,952

(22) Filed: May 29, 2006

(65) Prior Publication Data

US 2007/0119793 A1 May 31, 2007

(30) Foreign Application Priority Data

Nov. 25, 2005 (CN) ..... 2005 2 0119382

(51) Int. Cl.
*H05K 5/00* (2006.01)
*H05K 7/00* (2006.01)

(52) U.S. Cl. ..... 361/679.33; 361/679.37

(58) Field of Classification Search ..... 361/679.33, 361/679.37

See application file for complete search history.

(56) References Cited

U.S. PATENT DOCUMENTS 6,305,660 B1 * 10/2001 Liao ..... 248/694
7,259,959 B2 * 8/2007 Tu et al. ..... 361/679.33

FOREIGN PATENT DOCUMENTS

| | | |
|---|---|---|
| TW | 190919 | 9/1992 |
| TW | 211361 | 8/1993 |
| TW | 224797 | 6/1994 |
| TW | 458302 | 10/2001 |

* cited by examiner

*Primary Examiner*—Jayprakash N Gandhi
*Assistant Examiner*—Anthony M Haughton
(74) *Attorney, Agent, or Firm*—Wei Te Chung

(57) ABSTRACT

A mounting apparatus for mounting a data storage device that defines a locking hole in a sidewall thereof includes a bracket for holding the data storage device, and a locking member. The bracket includes a first side wall defining a through-hole. The locking member includes a mounting member mounted to the first side wall of the bracket, and a securing member rotatably mounted to the mounting member. The securing member includes a post extending therefrom. The securing member is selectively located in two positions. In a first position, the post passes through the through-hole of the bracket to engage with the locking hole of the data storage device. In a second position, the post is disengaged from the locking hole.

18 Claims, 9 Drawing Sheets

MOUNTING APPARATUS FOR DATA STORAGE DEVICES

FIELD OF THE INVENTION

The present invention relates to mounting apparatuses, and particularly to a mounting apparatus readily allowing installation or removal of a data storage device thereto or therefrom.

DESCRIPTION OF RELATED ART

Generally speaking, when a computer is assembled, a drive bracket is mounted in a computer enclosure, and then data storage devices are fixed to the drive bracket. The data storage devices comprise various combinations of hard disk drives (HDDs), floppy disk drives (FDDs), and compact disk-read only memory (CD-ROM) drives.

A conventional data storage device is generally attached to a drive bracket by bolts or rails. Examples are disclosed in Taiwan Patent Application Nos. 82202124, 81207129, and 82207667. Fixing a data storage device to a drive bracket with bolts is unduly laborious and time-consuming. Furthermore, the computer enclosure needs extra operating space for carrying out repairs. Repairing a data storage device in a drive bracket with rails is more convenient than using the above-described bolts. However, certain bolts are still needed to fix the rails to the drive bracket. Additionally, mounting systems using rails require a clearance between the data storage device and the drive bracket. This may cause electromagnetic interference (EMI) problems, and may lead to accumulation of static charges on the computer enclosure. Furthermore, the rails are generally made of plastic. This not only restricts grounding connection options between the data storage device and the drive bracket, but also tends to lead to extra maintenance, because plastic rails may easily wear out and require replacement.

What is desired, therefore, is a mounting apparatus which readily allows installation or removal of a data storage device thereto or therefrom.

SUMMARY OF THE INVENTION

An exemplary mounting apparatus for mounting a data storage device that defines a locking hole in a sidewall thereof includes a bracket for holding the data storage device, and a locking member. The bracket includes a first side wall defining a through-hole. The locking member includes a mounting member mounted to the first side wall of the bracket, and a securing member rotatably mounted to the mounting member. The securing member includes a post extending therefrom. The securing member is selectively located in two positions. In a first position, the post passes through the through-hole of the bracket to engage with the locking hole of the data storage device. In a second position, the post is disengaged from the locking hole.

Other advantages and novel features will become more apparent from the following detailed description when taken in conjunction with the accompanying drawings, in which:

DETAILED DESCRIPTION OF THE INVENTION

Figure 1:
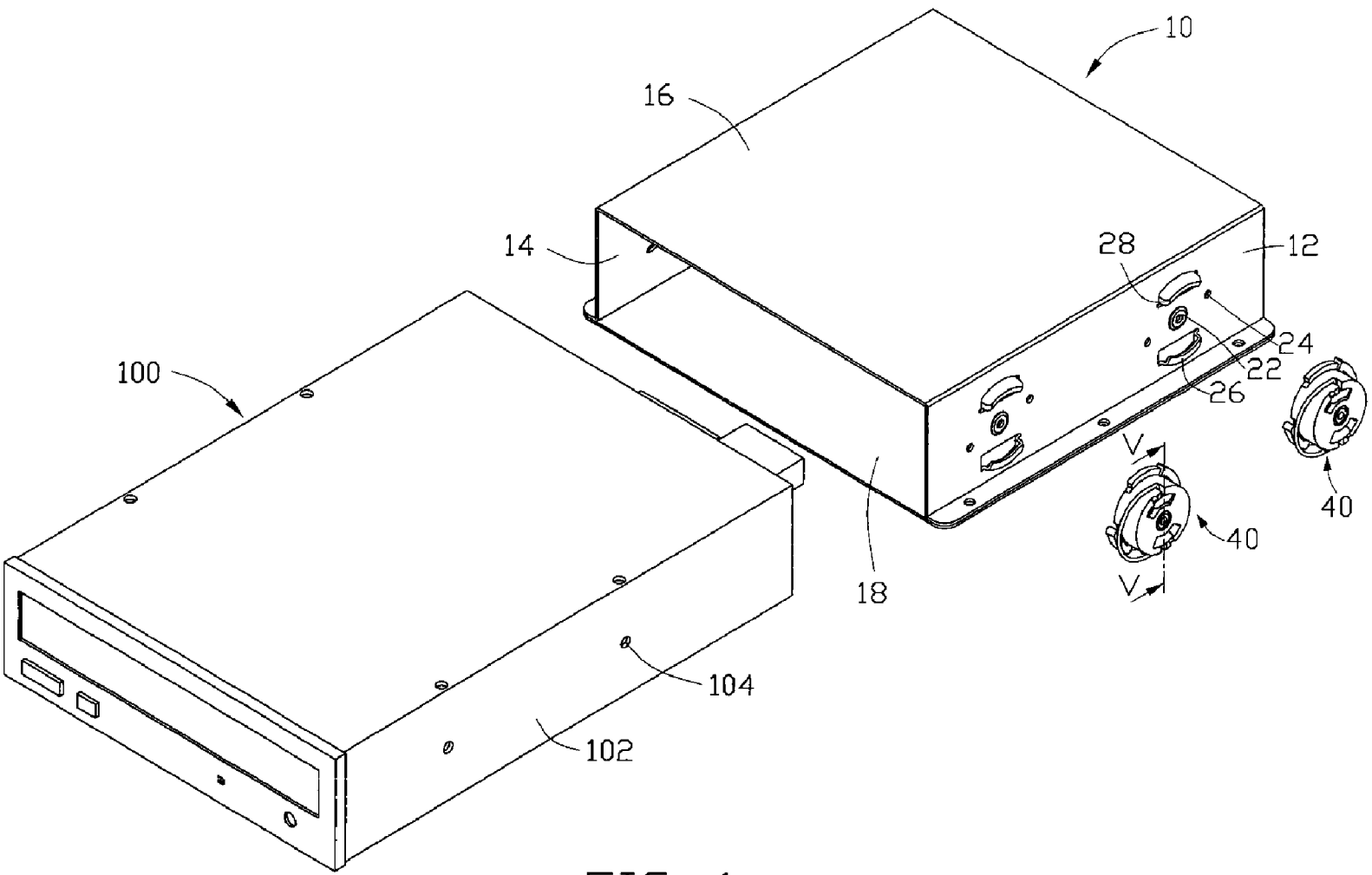
FIG. 1 is an exploded, isometric view of a mounting apparatus for a data storage device in accordance with a preferred embodiment of the present invention, together with a data storage device, the mounting apparatus includes a bracket, and a pair of locking members.

Referring to FIG. 1, a mounting apparatus of an electronic device like a computer in accordance with a preferred embodiment of the present invention is shown for mounting a functional component like a data storage device 100 to an enclosure of the computer. The data storage device 100 defines a pair of locking holes 104 in a sidewall 102 thereof. The mounting apparatus includes a bracket 10 mounted to the computer enclosure, and a pair of locking members 40.

Figure 2:
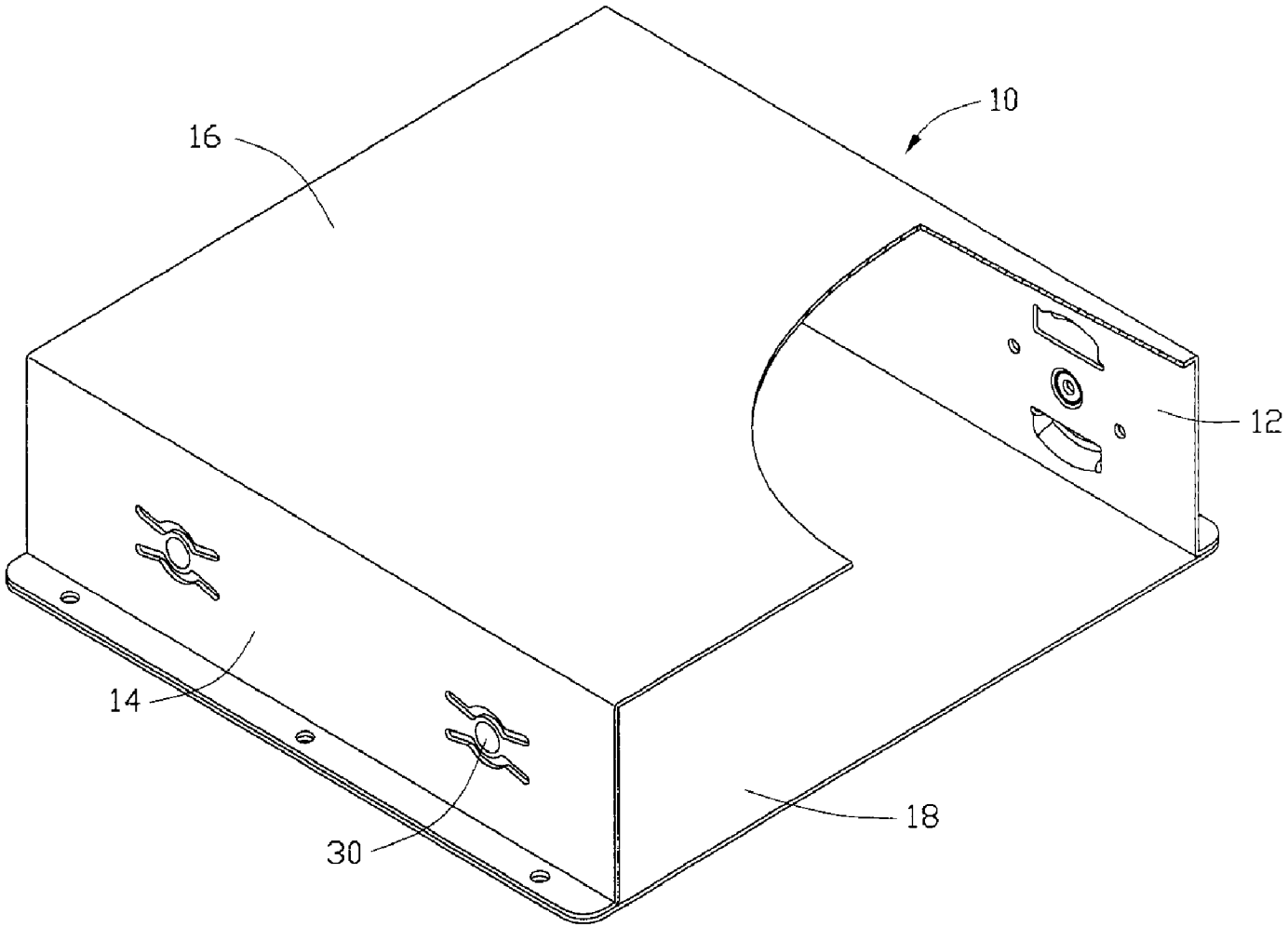
FIG. 2 is an isometric view of the bracket of FIG. 1, but viewed from another aspect and partially cutaway.

Referring also to FIG. 2, the bracket 10 includes a first side wall 12, a second side wall 14 parallel to the first side wall 12, a top wall 16 connecting tops of the first side wall 12 and the second side wall 14, and a bottom wall 18 connecting bottoms of the first side wall 12 and the second side wall 14. The first side wall 12 defines a pair of through-holes 22 therein. Two pairs of locating holes 24 are defined in the first side wall 12. The locating holes 24 of each pair are located at opposite sides of a corresponding through-hole 22. Two pairs of arc-shaped rails 26 are stamped outwardly from the first side wall 12. The rails 26 of each pair are located at opposite sides of a corresponding through-hole 22 and extend along a circumference round the through-hole 22. The rails 26 are symmetrically alternated with the locating holes 24. A blocking tab 28 is bent toward the inside of the circumference from a first end of each rail 26 in a clockwise direction. A pair of resilient tabs 30 is stamped from the second side wall 14.

Figure 3:
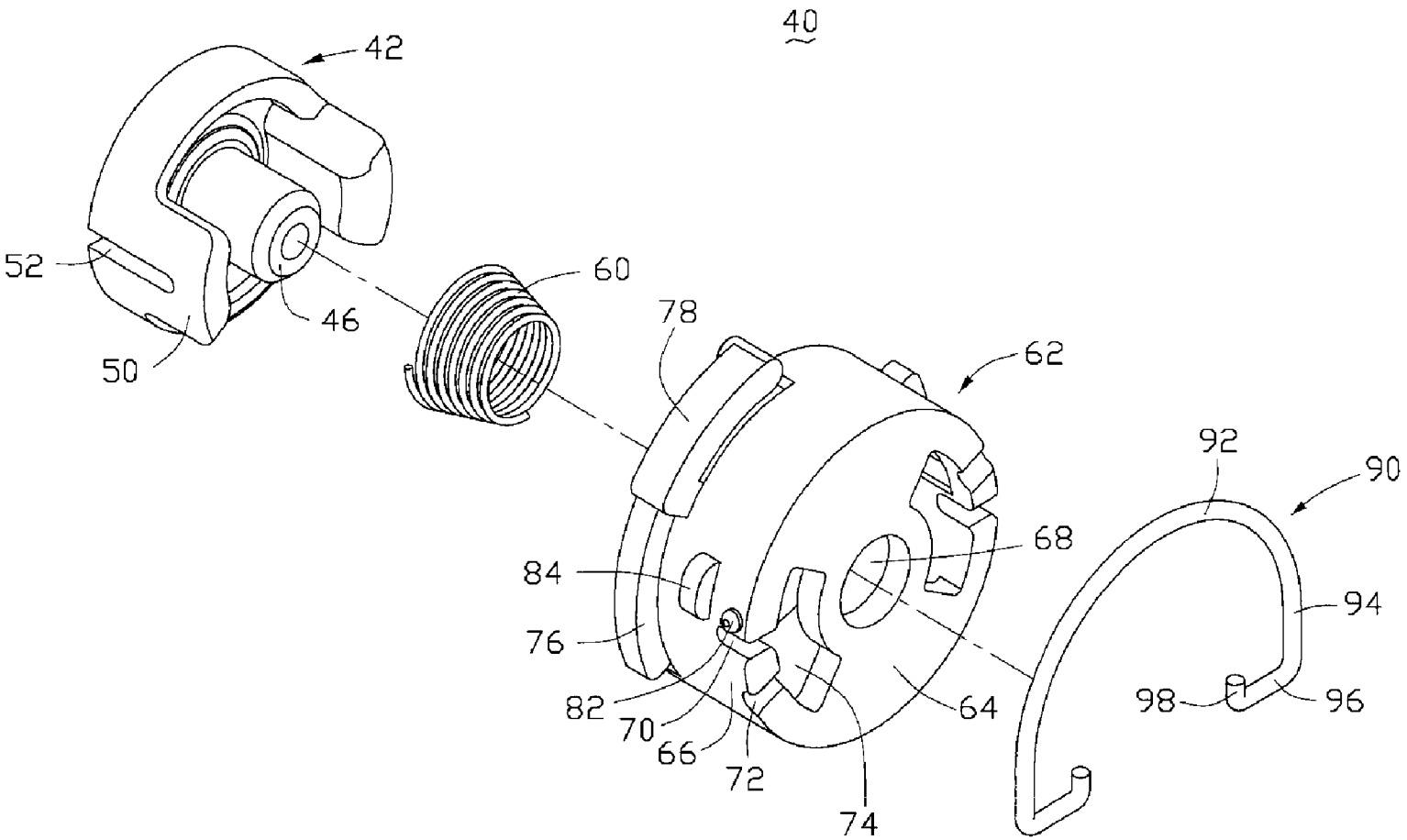
FIG. 3 is an exploded, isometric view of the locking member of FIG. 1.
Figure 4:
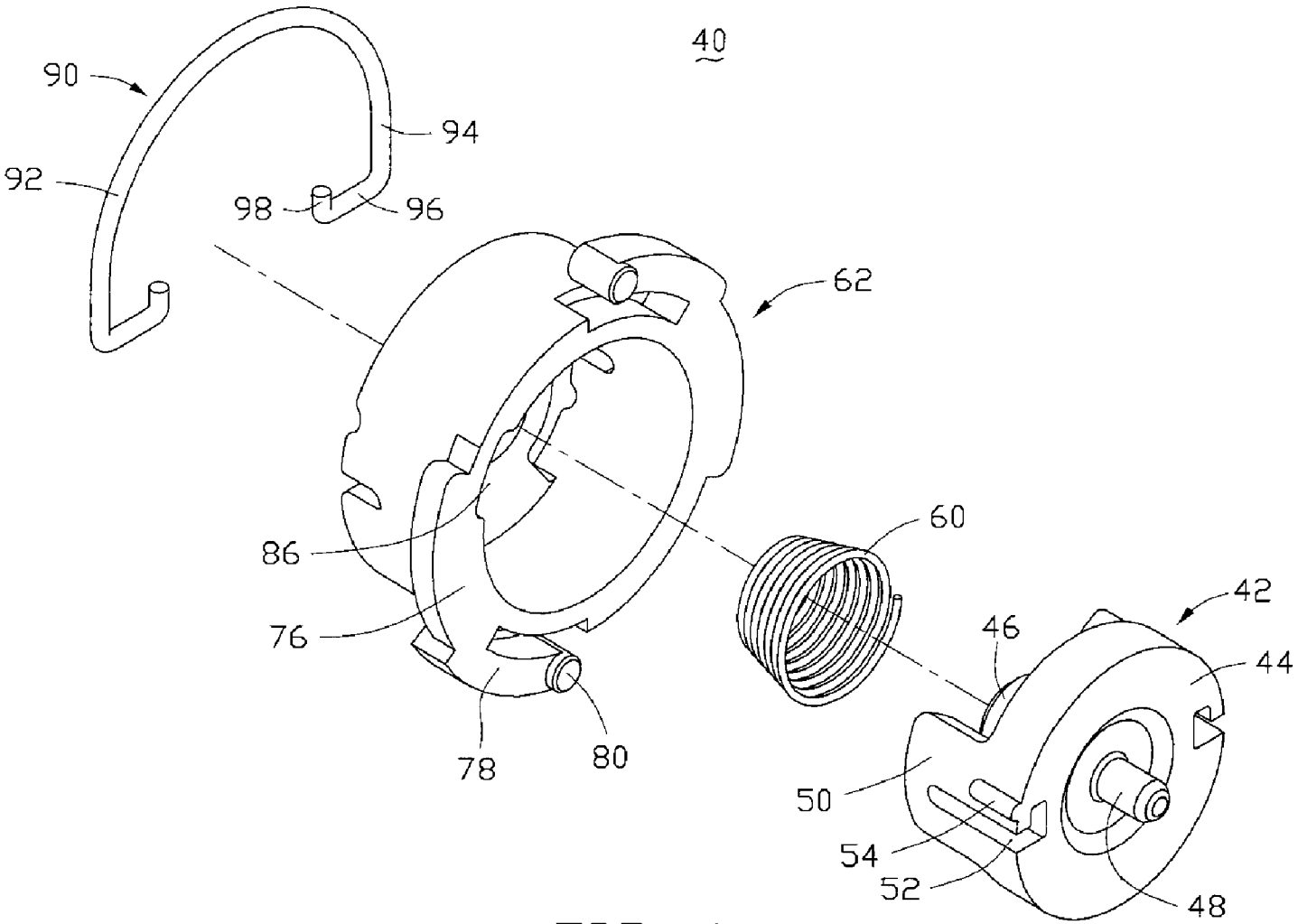
FIG. 4 is similar to FIG. 3, but viewed from another aspect.
Figure 5:
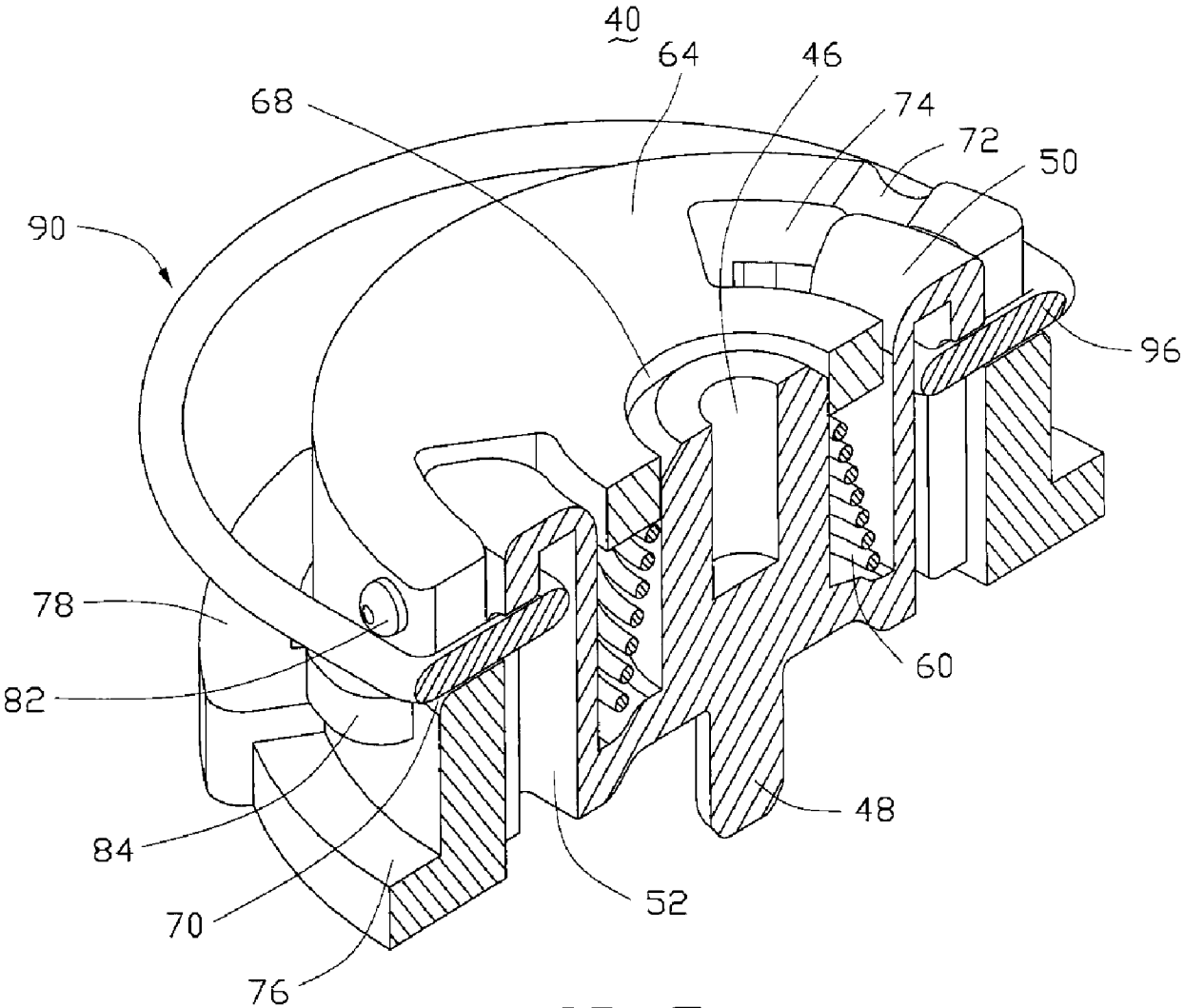
FIG. 5 is a cross-sectional view taken along the line V-V of the locking member of FIG. 1, but viewed from another aspect.
Figure 6:
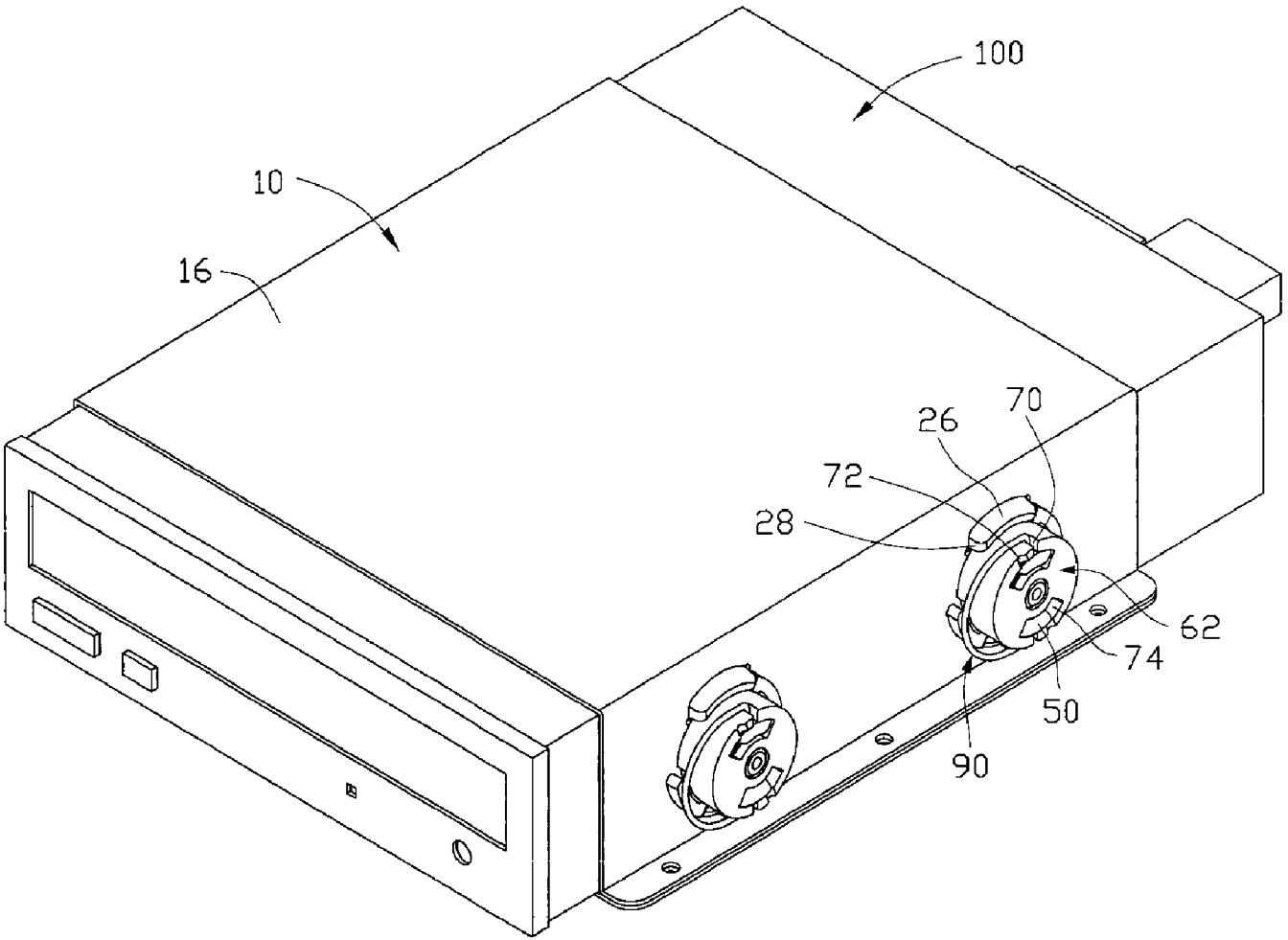
FIG. 6 is an assembled view of FIG. 1, showing the locking members in a locked position.
Figure 7:
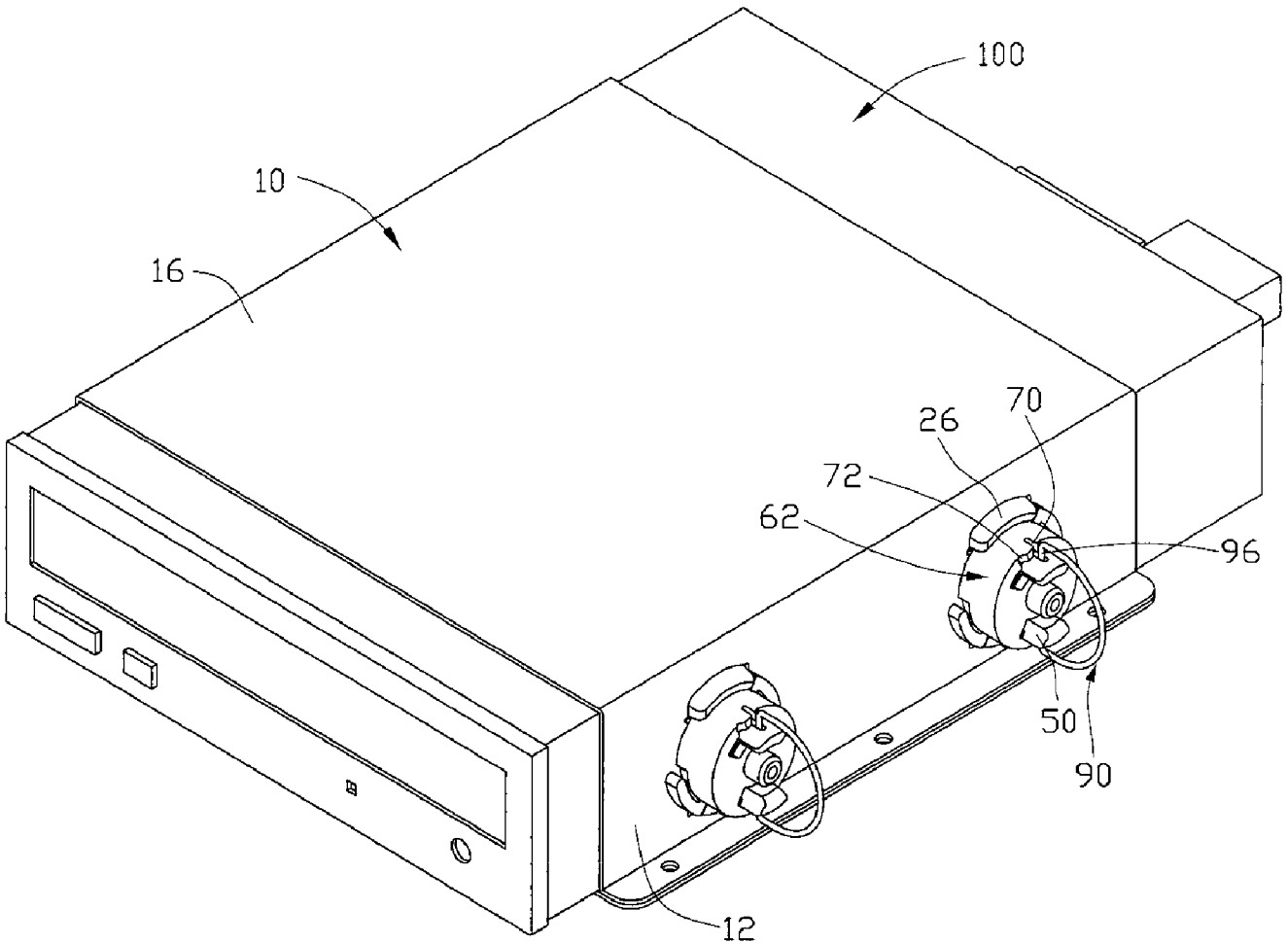
FIG. 7 is similar to FIG. 6; but showing the locking members in a first unlocked position.
Figure 8:
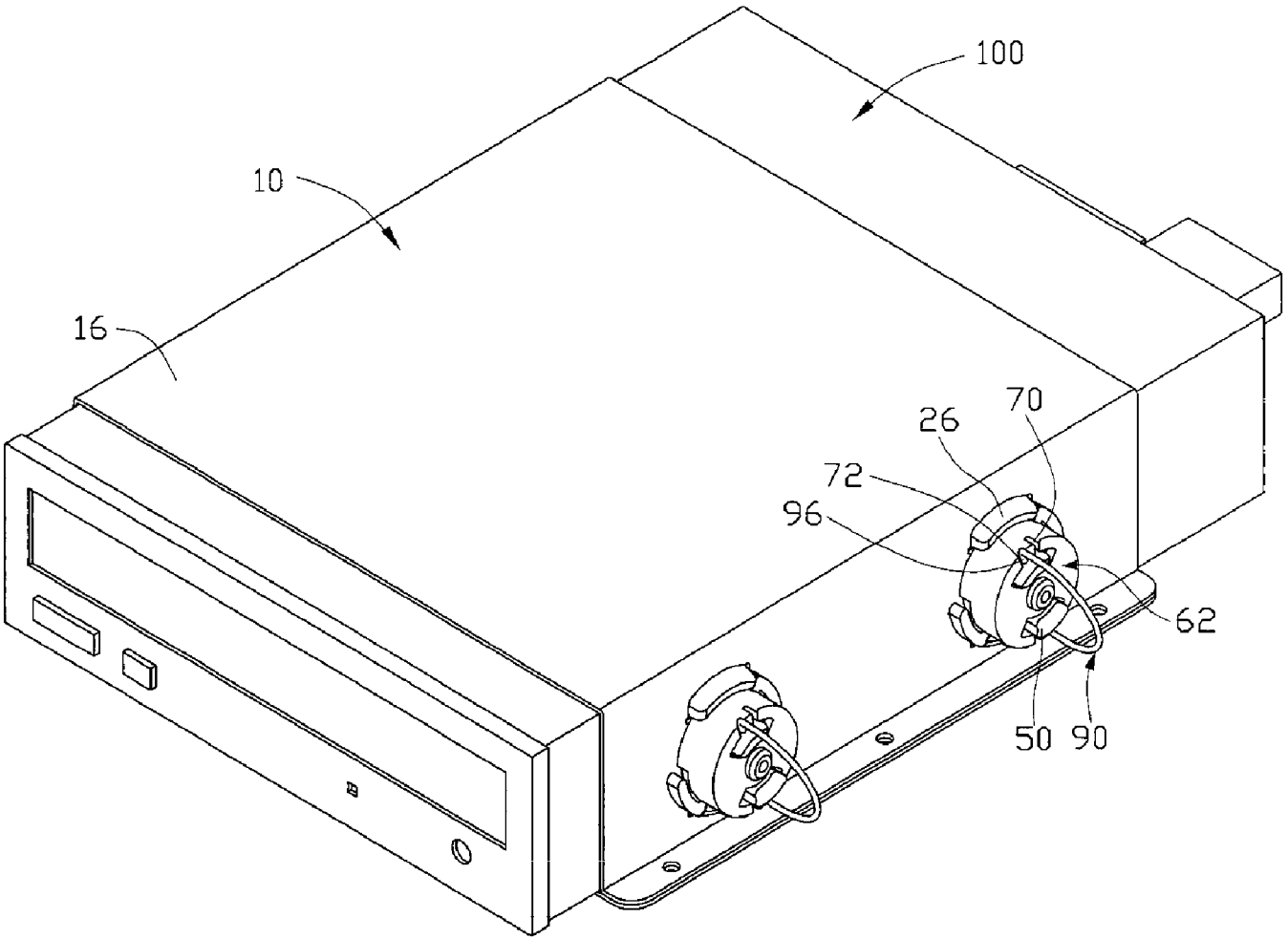
FIG. 8 is similar to FIG. 7, but showing the locking members in a second unlocked position.
Figure 9:
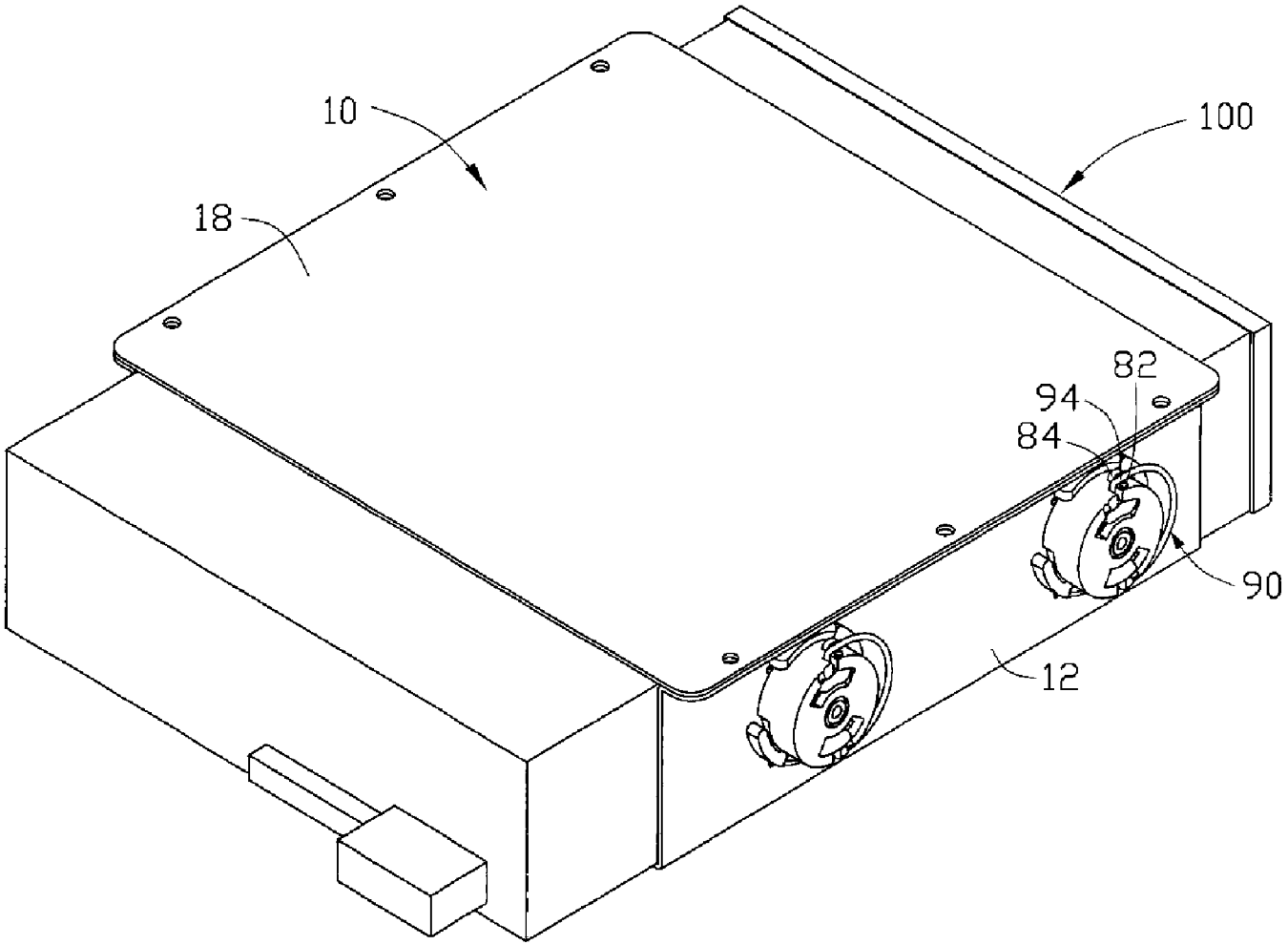
FIG. 9 is similar to FIG. 6, but an inverted view.

Referring also to FIGS. 3 to 5, each locking member 40 includes a securing member 42, a resilient member 60, a mounting member 62, and an elastic operating member 90.

The securing member 42 includes a circular body 44, a pillar 46 extending from a center of the body 44, and a post 48 opposite to the pillar 46 extending from the center of the body 44. A pair of ears 50 parallel to the pillar 46 and opposite to each other extends from a circumference of the body 44. L-shaped retaining slots 52 are defined in the securing member 42 extending from opposite sides of the body 44 to each ear 50. A guiding rib 54 protrudes out from one of the pair of ears 50 adjacent the corresponding retaining slot 52.

The resilient member 60 having a truncated conical shape is a coil spring.

The mounting member 62 includes a circular main part 64 and a cylinder 66 extending from a circumference of the main part 64. A receiving hole 68 is defined in a center of the main part 64 for holding a distal end of the pillar 46 of the securing member 42 therein. A first locating slot 70 is defined in each of two opposite edges of the mounting member 62 at junctions of the main part 64 and the cylinder 66. A second locating slot 72 is defined adjacent each first locating slot 70 in the mounting member 62. A depth of each first locating slot 70 is greater than that of each second locating slot 72. An opening 74 is defined between each first locating slot and the receiving hole 68 in the main part 64. Each opening 74 communicates with a corresponding first locating slot 70 and a corresponding second locating slot 72. Each of a pair of projecting portions 76 are formed on opposite sides of, and protrudes outwardly from, a bottom of the cylinder 66. The projecting portions 76 extend along a circumference of the cylinder 66. An elastic arm 78 extends along the circumference of the cylinder 66 from a second end of each projection portion 76 in a clockwise direction. A locating post 80 protrudes from a distal end of each elastic arm 78 for being engaged in a corresponding locating hole 24 of the bracket 10. A limiting post 82 and a supporting tab 84 therebelow protrude out from the cylinder 66 adjacent a corresponding first locating slot 70. A guiding slot 86 is defined in an inner surface of the cylinder 66 for the guiding rib 54 of the securing member 42 sliding therein.

The operating member 90 includes a hemicyclic operating portion 92 having two distal ends. An extension portion 94 extends from each distal end of the operating portion 92. A connecting portion 96 extends perpendicularly inward from a distal end of each extension portions 94. An orientating portion 98 extends perpendicularly inward from a distal end of each connecting portion 96.

Referring also to FIGS. 6-9, in assembling each locking member 40, the resilient member 60 fits about the pillar 46 of the securing member 42. The securing member 42 is received in the cylinder 66 of the mounting member 62. A distal end of the pillar 46 is received in the receiving hole 68 of the mounting member 62. The ears 50 of the securing member 42 are received in the corresponding openings 74 of the mounting member 62. The guiding rib 54 of the securing member 42 is received in the guiding slot 86 of the mounting member 62. The connecting portions 96 and the orientating portions 98 of the operating member 90 are inserted through the corresponding first locating slots 70, and the corresponding retaining slots 52 of the locking member 50. The orientating portions 98 of the operating member 90 are received in the retaining slots 52. Thus, the locking member 40 is formed.

In assembling each locking member 40 to the bracket 10, the post 48 aligns with the through-hole 22 of the bracket 10. The projection portions 76 of the mounting member 62 are received in the corresponding rails 26 of the bracket 10 from a second end in the clockwise direction and slide on the rails 26 in an anti-clockwise direction. The locating posts 80 are engaged with the corresponding locating holes 24 of the bracket 10. The blocking tabs 28 of the bracket 10 block corresponding ends of the projection portions 76. Thus, the locking member 40 is mounted to the bracket 10.

In preparation for assembling the data storage device 100, pulling each operating member 90 causes the corresponding securing member 42 to move in a direction away from the bracket 10 thereby depressing the resilient member 60 within the mounting member 62. Thus, ensuring the post 48 of the securing member 42 is not penetrating beyond an edge of the through-hole 22 of the bracket 10. After the connecting portions 96 of the operation member 90 are separated from the corresponding first locating slots 70 of the mounting member 62, the operating member 90 is rotated. When the connecting portions 96 move above the corresponding second locating slots 72 of the mounting member 62, the operating member 90 is released. The resilient member 60 is elastically restored. The securing member 42 moves toward the bracket 10. The connecting portions 96 of the operating member 90 are located in the corresponding second locating slots 72 of the mounting member 62.

In assembling the data storage device 100, the data storage device 100 is inserted into the bracket 10. The locking holes 104 of the data storage device 100 align with the corresponding through-holes 22 of the bracket 10. Each operating member 90 is pulled away from the bracket 10, and then is rotated. When the connecting portions 96 of the operating member 90 become aligned with the corresponding first locating slots 70, the operating member 90 is released. The corresponding resilient member 60 is elastically restored. The securing member 42 moves toward the bracket 10. The post 48 of the securing member 42 passes through the corresponding through-hole 22 of the bracket 10 and engages with the corresponding locking hole 104 of the data storage device 100. The connecting portions 96 of the operating member 90 are located in the corresponding first locating holes 70 of the mounting member 62. The resilient tabs 30 of the bracket 10 are elastically attached to an opposite sidewall of the data storage device 100. Thus, the data storage device 100 is secured. Then, each operating member 90 is rotated to make a corresponding extension portion 94 thereof to be located between a corresponding limiting post 82 and a corresponding supporting tab 84 of the mounting members 62.

In disassembling the data storage device 100, pulling each operating member 90 to move from corresponding first locating slots 70 to corresponding second locating slots 72 will disengage the posts 48 from the locking holes 104.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment of the invention.

What is claimed is:

1. A mounting apparatus for mounting a data storage device that defines a locking hole in a sidewall thereof, comprising:

a bracket for holding the data storage device comprising a first side wall that defines a through-hole;

a locking member comprising a mounting member mounted to the first side wall of the bracket, and a securing member rotatably mounted to the mounting member, the mounting member comprises a limiting post and a supporting tab adjacent to the limiting post, the securing member comprising a post, the securing member being selectively located in two positions, in a first position, the post passing through the through-hole of the bracket to engage with the locking hole of the data storage device, in a second position, the post being disengaged from the locking hole, and an operating member rotatably mounted to the locking member and capable of being located between the limiting post and the supporting tab;

wherein rotation of the operating member is blocked in response to the operating member being located between the limiting post and a supporting tab, therefore, the securing member is prevented from moving from the first position to the second position.

2. The mounting apparatus as claimed in claim 1, wherein the locking member further comprises a resilient member connected between the mounting member and the securing member.

3. The mounting apparatus as claimed in claim 1, wherein the securing member comprises a circular body, and a pair of ear shaped portions extending from a circumference of the body, the post opposite to the ear shaped portions extends from a center of the body, the operating member is mounted between the ear shaped portions of the securing member, the mounting member comprises a circular main part defining a pair of openings for receiving the corresponding ear shaped portions therein.

4. The mounting apparatus as claimed in claim 3, wherein the mounting member further comprises a cylinder extending from a circumference of the main part, a pair of first locating slots is defined in each of two opposite edges of the mounting member at junctions of the main part and the cylinder, a second locating slot is defined adjacent each of the first locating slots in the mounting member, each opening communicates with a corresponding first locating slot and a corresponding second locating slot, the operating member is located to the first locating slots or the second locating slots to be located in the first position or the second position.

5. The mounting apparatus as claimed in claim 4, wherein a depth of each of the first locating slots is greater than that of each of the second locating slots.

6. The mounting apparatus as claimed in claim 5, wherein L-shaped retaining slots are defined in the securing member extending from opposite sides of the body to each of the ear shaped portions, the operating member is engaged with the retaining slots.

7. The mounting apparatus as claimed in claim 6, wherein the operating member comprises a hemicyclic operating portion having two distal ends, an extension portion extends from each of the distal ends of the operating portion, a connecting portion extends perpendicularly inward from a distal end of each of the extension portions for being located in a corresponding first locating slot or a corresponding second locating slot of the mounting member, an orientating portion extends perpendicularly inward from a distal end of each of the connecting portions for being engaged with a corresponding retaining slot of the securing member.

8. The mounting apparatus as claimed in claim 7, wherein the limiting post and the supporting tab therebelow protrude out from the cylinder of the mounting member adjacent to a corresponding first locating slot.

9. The mounting apparatus as claimed in claim 8, wherein a pillar opposite to the post extends from the center of the body of the securing member, a receiving hole is defined in a center of the main part of the mounting member for receiving the pillar.

10. The mounting apparatus as claimed in claim 4, wherein a pair of arc-shaped rails is stamped outwardly from the first side wall of the bracket, the rails are located at opposite sides of the through-hole and extend along a circumference round the through-hole, a pair of projection portions protrudes out from a bottom and extend along a circumference of the cylinder of the mounting member to slide on the corresponding rails of the bracket.

11. The mounting apparatus as claimed in claim 10, wherein each of a pair of locating holes is defined at opposite sides of the through-hole in the first side wall of the bracket, the locating holes are symmetrically alternated with the locating holes, an elastic arm extends from each of the projection portions and along the circumference of the cylinder of the mounting member, a locating post protrudes from a distal end of each of the arms for engaging with a corresponding locating hole of the bracket.

12. A mounting apparatus for mounting a data storage device that defines a locking hole in a sidewall thereof, comprising:

a bracket for holding the data storage device comprising a first side wall that defines a through-hole;

a locking member comprising a mounting member mounted to the first side wall of the bracket, and a securing member movably mounted to the mounting member, the securing member comprising a post extending therefrom; and an operating member arranged on the securing member, the operating member located in two different-height portions of the mounting member, so that the post of the securing member is selectable between engaging in the locking hole of the data storage device, and withdrawing from the locking hole of the data storage device;

wherein the locking member further comprises a resilient member connected between the mounting member and the securing member;

wherein the securing member comprises a circular body, and a pair of ear shaped portions extending from a circumference of the body, the post opposite to the ear shaped portions extends from a center of the body, the operating member is mounted to the ear shaped portions of the securing member, the mounting member comprises a circular main part defining a pair of openings for receiving the corresponding ear shaped portions therein; and wherein the mounting member further comprises a cylinder extending from a circumference of the main part, a pair of first locating slots is defined in each of two opposite edges of the mounting member at junctions of the main part and the cylinder, a second locating slot is defined adjacent each of the first locating slots in the mounting member, the operating member is locatable to the first locating slots or the second locating slots.

13. The mounting apparatus as claimed in claim 12, wherein a depth of each of the first locating slots is greater than that of each of the second locating slots.

14. An electronic device comprising:

an enclosure of said electronic device comprising a bracket defining a space therein;

a functional component removably installable inside said enclosure, and movable into said space of said bracket and removable out of said space through a first side of said bracket; and a locking member removably attachable to a second side of said bracket other than said first side thereof, said locking member comprising a securing member movable along a direction intersecting with said second side of said bracket between a first position thereof where said securing member reachably engages with said component in order to retain said component in said space when said component moves into said space, and a second position thereof where said securing member is spaced from said component in order to release said component in said space, said securing member being rotatable about said direction in said second position thereof in order to be held in said second position thereof;

wherein said securing member is unable to rotate about said direction in said first position thereof.

15. The electronic device as claimed in claim 14, wherein said securing member is urged to rotate and is held in said second position thereof by means of an operating member extending out of said securing member.

16. The electronic device as claimed in claim 15, wherein the locking member further comprises a mounting member retained to the second side of said bracket, and forming a limiting post and a supporting tab adjacent to the limiting post.

17. The electronic device as claimed in claim 16, wherein the mounting member comprises a cylinder, the securing member is rotatably received in the cylinder of the mounting member, the limiting post and the supporting tab protrude from an outside of the cylinder.

18. The electronic device as claimed in claim 17, wherein rotation of the operating member is blocked, in response to the operating member being located between the limiting post and a supporting tab, therefore, the securing member is prevented from moving from the first position to the second position.

* * * * *